United States Patent [19]

Takeda et al.

[11] Patent Number: 4,726,328

[45] Date of Patent: Feb. 23, 1988

[54] INDUCTION SYSTEM FOR VEHICLE POWERED BY AN AIR PROPELLER

[75] Inventors: Makoto Takeda, Shizuoka; Tatsuya Kamiya, Kakegawa, both of Japan

[73] Assignee: Yamaha Hatsudoki Kabushiki Kaisha, Japan

[21] Appl. No.: 896,421

[22] Filed: Aug. 13, 1986

[30] Foreign Application Priority Data

Aug. 14, 1985 [JP] Japan ..... 60-177496
Aug. 14, 1985 [JP] Japan ..... 60-177497

[51] Int. Cl.[4] ..... F02B 75/18
[52] U.S. Cl. ..... 123/52 M; 261/96
[58] Field of Search ..... 123/52 M, 52 MB, 52 MC, 123/52 MV; 261/DIG. 67, 96, 102; 180/7.4, 116, 903; 440/37

[56] References Cited

U.S. PATENT DOCUMENTS 3,368,326 2/1968 Hervert ..... 261/DIG. 67
3,814,392 6/1974 Boyd et al. ..... 261/DIG. 67
3,916,020 10/1975 Malphettes et al. ..... 261/DIG. 67
4,134,378 1/1979 Kingsley ..... 261/DIG. 67
4,155,266 5/1979 Bradley ..... 123/195 A
4,448,734 5/1984 Shibano ..... 261/DIG. 67
4,499,032 2/1985 Shibano ..... 261/DIG. 67
4,658,795 4/1987 Kawashima et al. ..... 261/DIG. 67

FOREIGN PATENT DOCUMENTS 0156233 12/1980 Japan ..... 261/DIG. 67
0806889 2/1981 U.S.S.R. ..... 123/198 E
1021224 8/1984 U.S.S.R. ..... 123/198 E

*Primary Examiner*—Charles J. Myhre
*Assistant Examiner*—David A. Okonsky
*Attorney, Agent, or Firm*—Ernest A. Beutler

[57] ABSTRACT

A vehicle driven by an air propeller which is, in turn, powered by an internal combustion engine. An improved induction system is provided wherein both the carburetor fuel bowl vent and the air intake of the engine are protected from pressure differences generated by the action of the propeller.

13 Claims, 4 Drawing Figures

INDUCTION SYSTEM FOR VEHICLE POWERED BY AN AIR PROPELLER

BACKGROUND OF THE INVENTION

This invention relates to vehicles powered by air propellers and more particularly to an improved induction system for the driving engine of the propeller.

A wide variety of vehicles, both land, water and air are driven by air propellers. The propeller is driven by an associated engine and the engine is normally placed in close proximity to the propeller. With many of these types of vehicles, such as those generally referred to as swamp buggies that operate on the water, the engine is relatively exposed and thus the air flow created by the propeller passes across the engine. Although this has certain advantages, it presents a number of problems in the design of the engine components, such as its induction system.

A first of the problems with designing the induction system for a vehicle of this type is that the carburetor normally has its fuel bowl vented to atmospheric pressure so as to balance the amount of the fuel discharged to the engine in response to the difference between atmospheric pressure and induction system pressure. However, if the carburetor is placed downstream of the propeller and is located in its wash or if it is upstream, the fuel bowl vent will be subjected to a pressure other than atmospheric due to the airflow caused by the propeller. As a result, there can be improper amount of fuel delivered to the engine, either too much if the location is in a high pressure area, or too low if the vent is in a low pressure area.

It is, therefore, a principle object of the this invention to provide an improved arrangement for controlling the air pressure delivered to a charge former of an internal combustion engine of an air propeller powered vehicle.

It is a further object of this invention to provide an improved fuel bowl venting arrangement for a carburetor having such an application.

In addition to the difficulties providing the proper pressure for the fuel bowl venting, the intake device for the air induction system of the engine also presents problems with this type of vehicle. Like the fuel bowl vent, if the induction system air inlet is disposed either downstream of the propeller in its wash, or upstream on its intake side, the airflow generated by the propeller can adversely affect the performance of the engine. Furthermore, the changes in airflow with engine speed can give rise to calibration problems. Although this problem could be avoided by providing a remote air inlet location, such remote inlet locations cause pressure losses that can diminish the performance of the engine.

It is, therefore, a still further object of this invention to provide an improved air induction system for the intake of an engine driving an air propeller powered vehicle.

It is a further object of this invention to provide an improved air intake device for a propeller driven vehicle.

SUMMARY OF THE INVENTION

A first feature of this invention is adapted to be embodied in a vehicle powered by an air propeller which is driven an internal combustion engine which engine is juxtaposed to the propeller and generally exposed. A charge forming device is provided for the engine that includes an air inlet. In accordance with this feature of the invention, means are provided for sheltering the air inlet from non-atmospheric pressures created by the propeller.

In accordance with one aspect of the invention, the air inlet comprises a fuel bowl vent and in accordance with another of the features of the invention, the air inlet comprises the air intake for the charge forming device.

A still further feature of this invention is adapted to be embodied in an air intake device for a propeller powered vehicle. The air intake device includes an outer housing that defines a closed upstream end and an opened downstream end. A spoiler encircles this open downstream end so as to create eddy currents around the air intake and improve the pressure at the intake regardless of the vehicle speed.

DETAILED DESCRIPTION OF THE PREFERRED EMBODIMENT OF THE INVENTION

Figure 1:
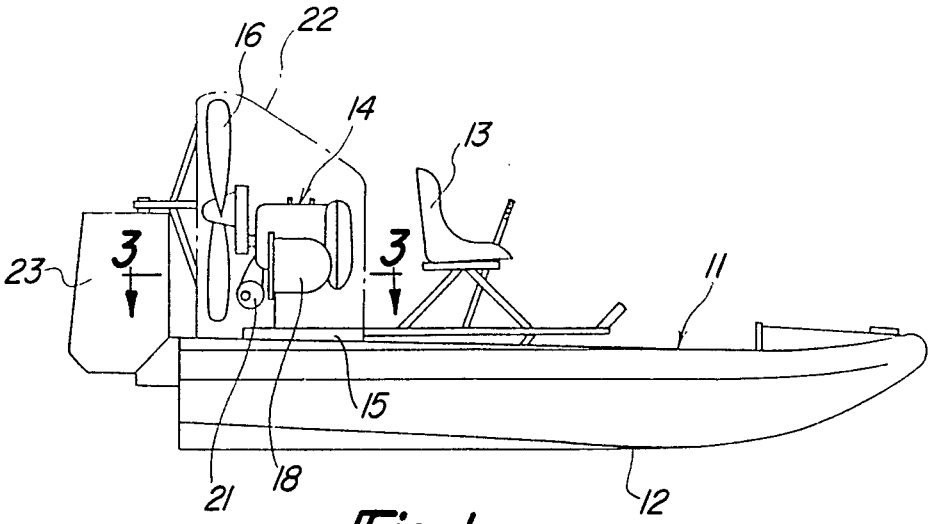
FIG. 1 is a side elevational view of a water craft powered by an air propeller driven by an engine and having an induction system constructed in accordance with an embodiment of the invention.
Figure 2:
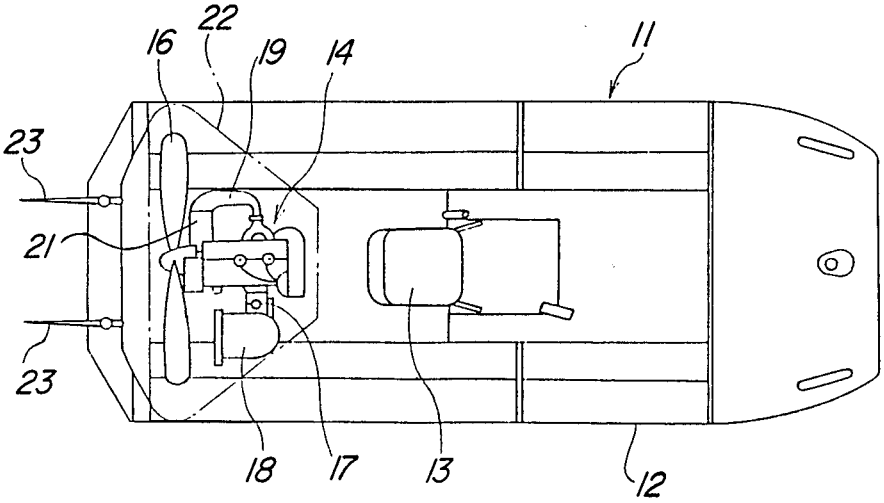
FIG. 2 is a top plan view of the water vehicle.

Referring first to FIGS. 1 and 2, a water craft powered by an engine having an induction system incorporating this invention is identified generally by the reference numeral 11. The water craft 11 is of the type known as the swamp buggy and is designed so as to operate with a very small water draft. The water craft 11 has a hull 12 that mounts a driver's seat 13 at a generally central location. Positioned rearwardly of the driver's seat is a powering engine 14, which may be of any known type and which is mounted in a generally exposed fashion on a platform 15 carried at the rear end of a hull 11. The engine 14 drives an air propeller 16 for powering the water craft 11 in a known manner.

The engine 14, which may be of any known type and which is depicted as being of the inline two cylinder type, includes an induction system that is comprised of one or more charge forming devices, indicated generally by the reference numeral 17, in the form of a carburetor which receives intake air from an air intake and air filter assembly, indicated generally by the reference numeral 18.

The exhaust gases from the engine are discharged through an exhaust manifold 19 to a muffler 21 for discharge to the atmosphere. In accordance with the normal practice with this type of vehicle, the engine 14 and propeller 16, as well as the intake device 18, are enclosed within a protective screen 22.

A pair of air rudders 23 are supported by the hull 12 rearwardly of the propeller 16 for steering of the water craft 11 in a manner as generally known in this art. The general construction and layout of the water craft 11, except for the induction system for the engine 14, may be considered to be conventional and for that reason details as to construction are not believed to be necessary to the understanding of the invention.

Figure 3:
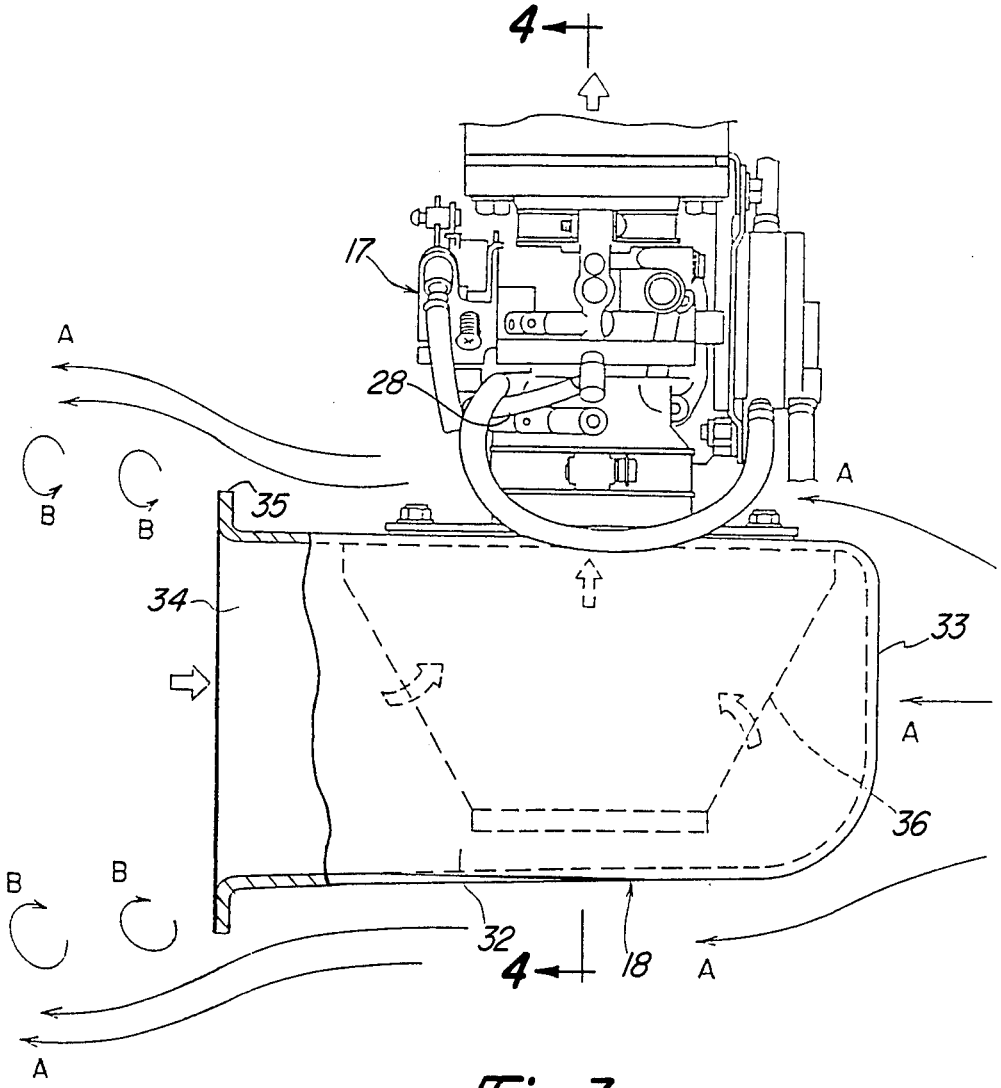
FIG. 3 is an enlarged cross-sectional view taken along the line 3—3 of FIG. 1.
Figure 4:
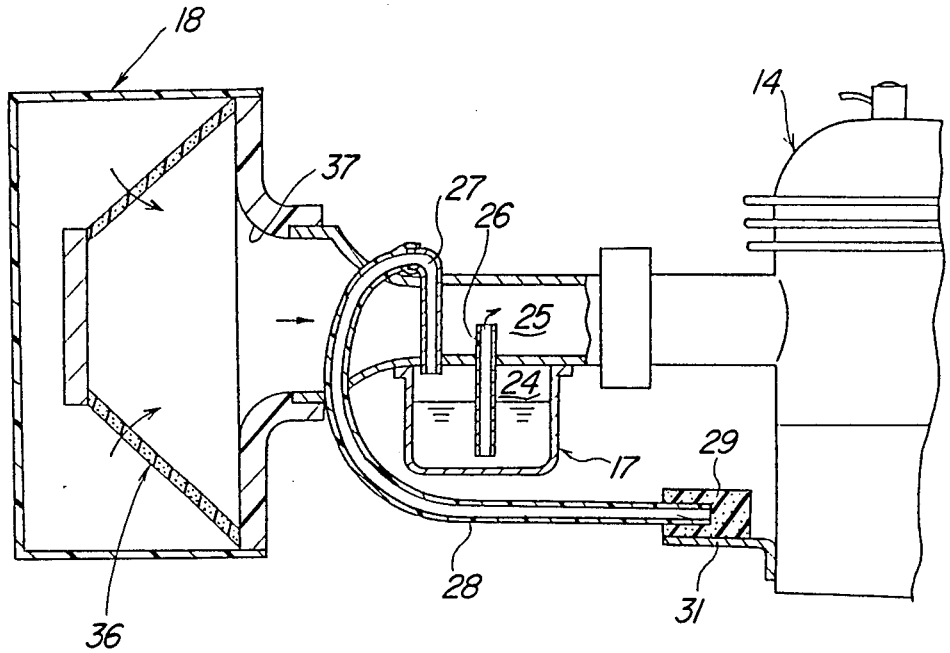
FIG. 4 is a cross-sectional view taken along the line 4—4 of FIG. 1 and on a reduced scale, which scale is larger than the scale of FIG. 1.

Referring now specifically to FIGS. 3 and 4, the engine and its induction system are illustrated in detail. The carburetor 17 is comprised of a main body portion that defines a fuel bowl 24. Fuel is supplied to the fuel bowl 24 from a remotely positioned fuel tank (not shown) and is maintained at a uniform head by means of a needle operated float valve (not shown). The fuel bowl 24 is disposed beneath an induction passage 25 through which air flows to the engine induction system. A main fuel discharge nozzle 26 discharges fuel into the induction passage 25 in a known manner. In addition, the carburetor 17 may include idle and transition circuit (not shown) of a known type and which deliver fuel from the fuel bowl 24.

It should be readily apparent that the amount of fuel discharged will be related to the pressure differences between that at the outlet end of the nozzle 26 and the discharge ports of the other fuel circuits and the pressure existent above the fuel in the fuel bowl 24. In accordance with normal practice, a fuel bowl vent 27 is provided for venting the area above the fuel in the fuel bowl 24 to atmospheric pressure.

As has been previously noted, the fact that the carburetor 17 is generally exposed in its position in line of the airflow across the propeller 16, atmospheric air pressure might not exist at the inlet to the fuel bowl vent 27. To avoid the uneven fuel flow that would result under these circumstances, a conduit 28 extends from the fuel bowl vent 27 and terminates within a porous member 29, such as the body of open cell foamed polyurethane, which is supported on a bracket 31 juxtaposed to the engine 14 and exposed generally centrally of the axis of rotation of the propeller 16. As a result, there will be minimum air pressure deviations in this area and any deviations which might occur will be damped by the porous body 29 so that uniform fuel air mixture will be discharged regardless of speed of rotation of the propeller 16.

In a similar manner, the juxtaposition of the air intake device 18 in the path of airflow across the propeller 16 could result in uneven airflows under varying conditions it could upset the calibration of the carburetor 17. However, the air intake 18 is constructed in such a way so as to minimize or substantially reduce the likelihood of pressure variations.

The air intake device 18 includes an outer casing, indicated generally by the numeral 32 which has a streamline shape and which is closed at its forward end by an integral end wall 31. An air inlet opening 34 is provided at the downstream end of the housing 32. As a result of this orientation airflow will not adversely affect the pressure at the inlet 34. In addition, the housing 32 is formed with an outwardly flanged spoiler section 35 that surrounds the inlet opening 34 and will create eddy currents or turbulence in the air that surround the inlet opening 34 and which disturb the laminar main air stream flow indicated by the arrows A. It should be noted that without the spoiler 35, that there would be a negative pressure at the inlet opening 34 that could adversely affect airflow since this negative pressure would be dependent upon the velocity of airflow. However, the spoiler 35 has been found to significantly reduce the effect of such flow difference.

A generally conical shaped air filter element 36 is supported within the housing 32 and encloses an opening 37 which delivers air to the carburetor 17. This way, the air delivered to the carburetor 17 will be filtered and will be at substantially atmospheric pressure.

It should be readily apparent from the foregoing description that the disclosed induction system insures that there will be a correctly metered air fuel ratio under all running conditions and that this air fuel ratio will not be adversely affected due to the action of the juxtaposed propellant.

Although an embodiment of the invention has been illustrated and described, various changes and modifications may be made without departing from the spirit and scope of the invention, as defined by the appended claims.

We claim:

1. In a vehicle powered by an air propeller driven by an internal combustion engine, said engine being juxtaposed to said propeller and generally exposed, and a charge forming device for said engine including an air inlet disposed in the path of air flow created by the rotation of said propeller, the improvement comprising means for sheltering said air inlet from pressures created by the flow of air across said propeller.

2. A vehicle powered by an air propeller according to claim 1 wherein the charge former includes a fuel bowl.

3. A vehicle powered by an air propeller according to claim 2 wherein the charge former comprises a carburetor.

4. A vehicle powered by an air propeller according to claim 1 wherein the means for sheltering the air inlet comprises means for diverting the airflow created by the propeller from the air inlet.

5. A vehicle powered by an air propeller according to claim 4 wherein the means for diverting the airflow comprises a body of porous material.

6. A vehicle powered by an air propeller according to claim 4 wherein the means for diverting the airflow comprises a shield.

7. A vehicle powered by an air propeller according to claim 6 wherein the shield comprises a housing defining a closed upstream end and an opened downstream end and further including a spoiler extending outwardly around the downstream end for disrupting laminar flow.

8. A vehicle powered by an air propeller according to claim 7 wherein the air inlet comprises the induction system air inlet for delivering combustion air to the engine.

9. A vehicle powered by an air propeller driven by an internal combustion engine, said engine being juxtaposed to said propeller and generally exposed, and a carburetor for said engine including a fuel bowl and an air inlet for venting said fuel bowl to the atmosphere, the improvement comprising means for sheltering said air inlet from pressures created by the flow of air across said propeller, said means for sheltering said air inlet from pressure comprising a porous body surrounding said air inlet.

10. A vehicle powered by an air propeller according to claim 9 wherein the inlet is disposed contiguous to the center of rotation of the propeller.

11. Air inlet device for a vehicle driven by an air propeller driven by an internal combustion engine, said air inlet device comprising an outer housing having a closed end disposed upstream of the airflow, an open end disposed downstream of the airflow and an outlet for communicating with the engine air induction system, and a spoiler surrounding said open end for generating eddy currents in the laminar flow across the outer housing.

12. A air inlet device according to claim 11 wherein the spoiler comprises a flange extending at right angles to the direction of air flow.

13. An air inlet device according to claim 11 further including an air filter element disposed within the outer housing.

* * * * *